US005277777A

United States Patent [19]

Olper et al.

[11] Patent Number: 5,277,777

[45] Date of Patent: Jan. 11, 1994

[54] INSOLUBLE ANODE FOR ELECTROLYSES IN AQUEOUS SOLUTIONS

[75] Inventors: Marco Olper, Monza; Pierluigi Fracchia, Milan, both of Italy

[73] Assignee: B.U.S. Engitec Servizi Ambientali S.R.L., Milan, Italy

[21] Appl. No.: 769,363

[22] Filed: Oct. 1, 1991

[51] Int. Cl.[5] ..... C25C 7/00

[52] U.S. Cl. ..... 204/286; 204/290 R; 204/290 F; 204/297 R; 204/297 W

[58] Field of Search ..... 204/290 R, 291, 297 R, 297 W, 786, 280, 290 F

[56] References Cited

U.S. PATENT DOCUMENTS

| | | | |
|---|---|---|---|
| 4,098,658 | 7/1978 | Ginatta | 204/114 |
| 4,108,756 | 8/1978 | de Nora | 204/286 |
| 4,236,978 | 12/1980 | Prengaman et al. | 204/57 |
| 4,272,340 | 6/1981 | Cole, Jr. et al. | 204/114 |
| 4,380,493 | 4/1983 | Wortley et al. | 204/105 |
| 4,400,259 | 8/1983 | Schutt | 204/196 |
| 4,767,519 | 8/1988 | de Nora | 204/255 |
| 5,030,520 | 7/1991 | Olper | 428/660 |

FOREIGN PATENT DOCUMENTS

| | | |
|---|---|---|
| 9003162.8 | 7/1990 | Fed. Rep. of Germany . |
| 2399490 | 3/1979 | France . |

*Primary Examiner*—Kathryn Gorgos
*Attorney, Agent, or Firm*—Foley & Lardner

[57] ABSTRACT

An insoluble anode is for the electrowinning of heavy metals from aqueous solutions which contain them, and for the electrolytic production of oxidizer halogenated salts.

The anode includes a copper bar acting as a bus bar (i.e., as a current-bearing bar), having vertical and horizontal holes through which fork-shaped elements, made from a bimetallic conductor, are inserted and fastened. A plurality of fork-shaped elements, made from the filamentary bimetallic conductor, coated by a catalytic layer of Pt and/or $PbO_2$, act as an electrode with preferential oxygen development. A framework made from an insulating plastics material, is for supporting and stiffening the structure, and for the precise positioning of the anode inside the cell.

11 Claims, 3 Drawing Sheets

INSOLUBLE ANODE FOR ELECTROLYSES IN AQUEOUS SOLUTIONS

BACKGROUND OF THE INVENTION

1. Field of the Invention

The extraction of heavy metals from the aqueous solutions of the salts which contain them, by electrolysis (electrowinning), requires the use of insoluble anodes which are good electrical conductors, and, simultaneously, are endowed with a high enough resistance to the electrolyte used and to the products from the relevant anodic reactions, and, finally, favor the development of oxygen.

2. Discussion of the Related Art

For those metals which are more commonly produced by this route: copper, nickel, manganese, zinc, cadmium, and so forth, the present art preferably uses anodes of bonded lead (with antimony, silver, calcium, and so forth).

In the usual sulfuric baths used to electrowin the above metals, the lead anodes get coated with a thin layer of lead sulfate which, by oxidation, is transformed into a layer consisting of Pb dioxide, which protects them from further corrosion and which, by being conductive, uses the development of $O_2$ with a suitably low oxygen overvoltage.

In order to electrowin copper and nickel from the solutions of their sulfates, anodes have been used for many years, which consist of lead containing 6–8% of Sb, and which are consumed very slowly, unless chloride ions are present in the electrolyte. Unfortunately, the anode of Pb/Sb does not prevent Pb from polluting the cathode.

On the contrary, for zinc electrowinning, anodes of Pb with 0.5–1% of Ag are used, which are obtained by casting or lamination, and sometimes are provided with grooves to favor oxygen development and other times are provided with circular holes to favor the circulation of the electrolyte. The conduction of electrical current throughout the anode is secured by inserting the copper bar inside the body of the same anode, by melting. The resistance of these anodes to chemical attack by the electrolyte is undoubtedly good, and the useful operating life of such electrodes is often longer than 2–3 years.

A negative characteristic consists in that, owing to the presence in the zinc-containing solution, of a certain level of manganous ions, adhering scales of $MnO_2$ are formed on the anode, which become thicker and thicker with time.

When these scales get detached, owing to natural processes, they release particles of $PbO_2$ and/or of $PbSO_4$, which increase the Pb level in the cathodic zinc.

Another common problem displayed by the lead anodes used in the above cited electrolyses, is the large amount of immobilized metal (the weight of an anode of the cells known from the prior art is always higher than 100 kg), and the costs deriving from the periodic restoration of the anodes. Furthermore, in many facilities, there is burdensome maintenance, due to the periodic removal of the scales (every 2–4 weeks), which is carried out in order to improve the quality of produced zinc, and reduce the cell voltage.

The production of lead by the electrolytic route is presently the focus of interest of the big metallurgical industry: the fluoroboric and fluorosilicic electrolytes, preferred owing to the higher quality of deposits which can be obtained, causes serious problems of resistance of the anodic material to arise.

E. R. Cole et al., U.S. Pat. No. 4,212,340, uses an anode constituted by a titanium sheet electrolytically coated with a thin-texture layer of $PbO_2$, with a particularly compact structure.

M. Ginatta, U.S. Pat. No. 4,098,658, uses anodes made from graphite bars, which get naturally coated with $PbO_2$, and are sheltered by it.

R. D. Prengaman et al., U.S. Pat. No. 4,236,978 uses anodes made from a graphite plate wrapped in a net made from a plastics material, which serves as a reinforcement for the deposit of $PbO_2$, and counteracts the brittleness thereof.

All these types of anodes display a poor electrical conductivity, are rather brittle, and their useful operating life is rather short.

Also, the problems caused by the anodic materials used to produce oxidizer halogenated salts (at present, activated Ti or Pt are used), are not completely solved.

SUMMARY OF THE INVENTION

In EP Public. No. 328 189, the European counterpart of U.S. Pat. No. 5,030,520, to Marco Olper, an electrical conductor is disclosed, which is suitable, in particular, for use as an insoluble anode in electrowinning processes and electrochemical processes in general, which is characterized in that it is constituted by a bimetallic wire composed by an inner copper core, coated by a thinner, external layer of a transition metal preferably selected from tantalum, titanium and niobium.

The present invention proposes to use an electrical conductor of the above EP Public. No. 328189 to the same Applicant's name and, as its main purpose, aims at supplying, with it, an anodic structure which is particularly resistant to the electrolytes and to the very aggressive products from the anodic reaction, which are found in the electrowinning of the main heavy metals (copper, nickel, zinc, cadmium, lead, and so forth) from the aqueous solutions of their salts.

In particular, the anodic structure of the present invention should also be suitable for being advantageously used for the electrolytic production of a large number of oxidizer halogenated salts (chlorates and perchlorates, bromates and perbromates, iodates and periodates), which require that an anodic material is used, which displays a particularly high resistance to corrosion.

In order to achieve such purposes, the present invention proposes an insoluble anode for the electrolysis of aqueous solutions, characterized in that the anode comprises a framework which supports a bus bar of copper provided with vertical holes, and a plurality of electrical conductors, including by bimetallic wires having an inner copper core coated by an outer, thinner layer of a transition metal, with each of the bimetallic wires being given a fork shape, which fork is fastened in a vertical position onto said framework, so that the free ends of each of said fork-shaped elements pass through the above said vertical holes provided in said bus bar.

The transition metals preferably are tantalum (Ta), titanium (Ti), niobium (Nb).

BRIEF DESCRIPTION OF THE DRAWINGS

In order to better describe the features and advantages of the instant invention, an exemplifying form of practical embodiment thereof—which in no way should be construed as being limitative thereof—is disclosed in the following, with reference to the figures of the accompanying drawings.

In the Drawings.

DETAILED DESCRIPTION OF THE PREFERRED EMBODIMENTS

Figure 1:
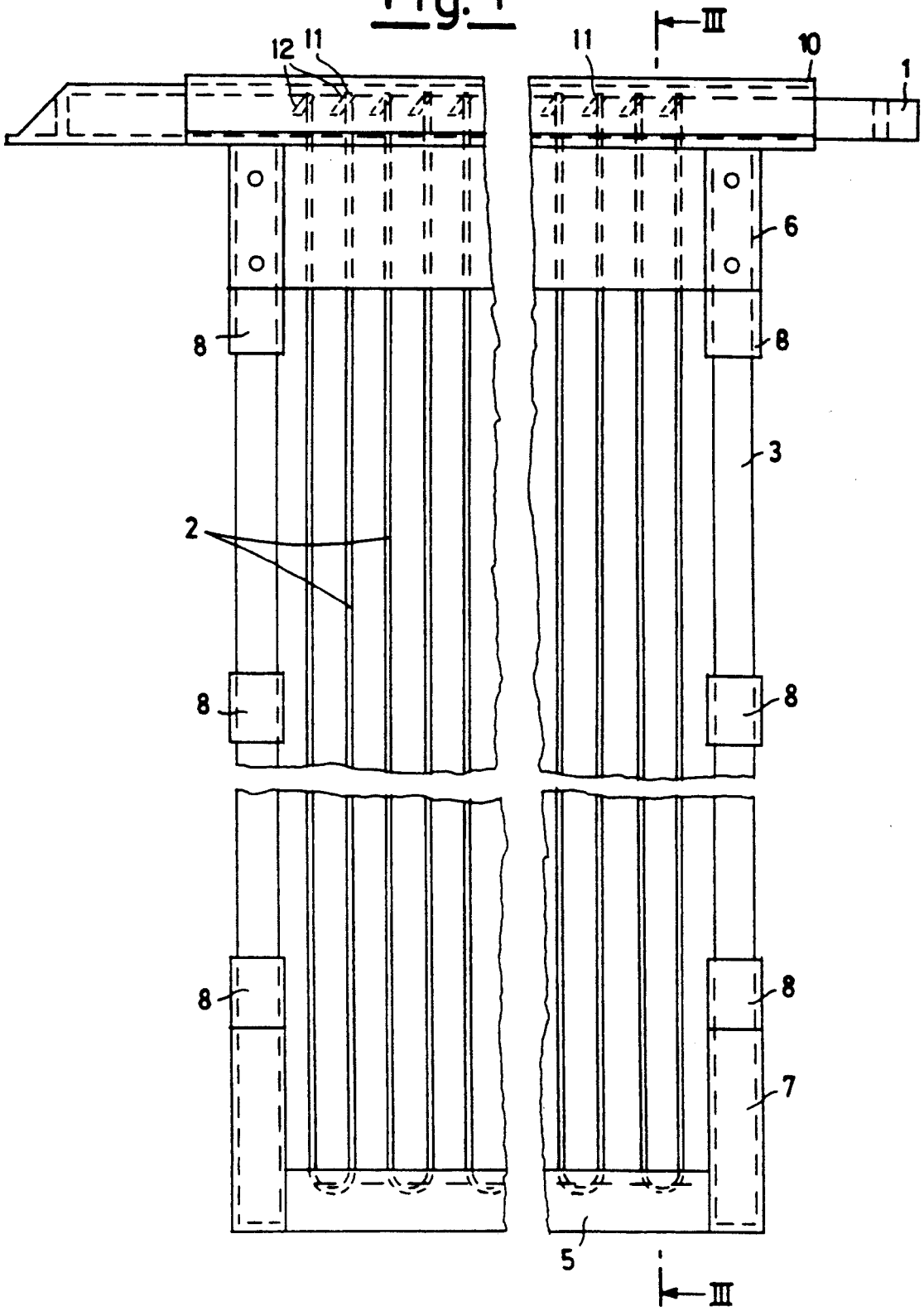
FIG. 1 shows a front elevation view of an anode according to the present invention.
Figure 2:
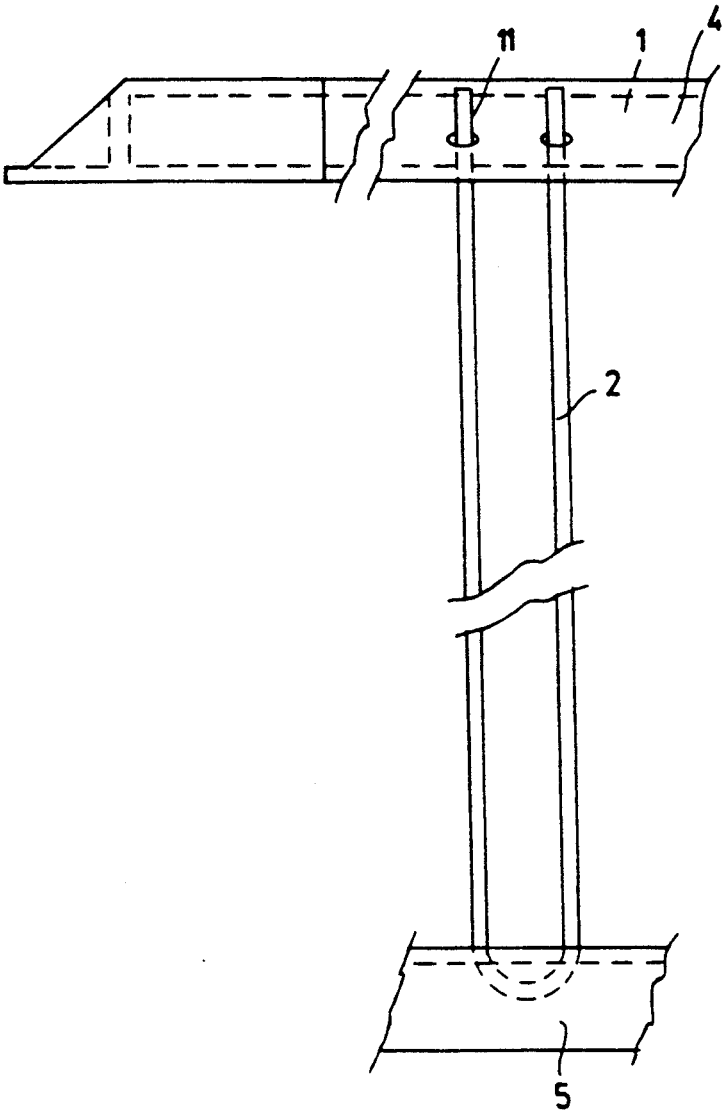
FIG. 2 shows a schematic perspective view of a detail of the anode according to the present invention.

Referring to such figures, an anode according to the present invention comprises a copper bar 1 with a rectangular cross-section, which acts as a bus bar (i.e., a current bearing bar), provided with vertical holes 11 for inserting through, and horizontal screw-threaded holes 12 for fastening onto the bus bar, the free ends of fork-shaped elements 2 made from a bimetallic conductor such as a compound material comprised of copper and tantalum, niobium, or titanium, coated with a catalytic layer of Pt and/or $PbO_2$. The fork-shaped elements behave as an electrode with preferential oxygen development, and are positioned on a same plane, so as to form a plurality of longitudinal, co-planar wires.

The bus bar 1 and the fork-shaped elements 2 are all supported by a framework 3, which comprises a pair of uprights made from an insulating plastics material, which performs the function of stiffening the overall structure, so as to make it possible the same anode to be precisely positioned inside the cell.

In the accompanying figures, the following are moreover displayed:

a structural shape made from a plastic material 4, which constitutes the upper horizontal side of the framework 3, and also performs the function of protecting the copper bar from the acidic mists which can be evolved from the surface of the electrolytic bath;

a structural shape made from a plastics material 5, which constitutes the lower horizontal side of the framework, inside which the "U"-shaped portion between the forks of the fork-shaped elements made of bimetallic conductor enters;

upper joints 6 and lower joints 7 between the vertical and horizontal sides of the framework;

spacers 8 made from a plastics material, slid through, and fastened at predetermined levels onto, the vertical uprights of the framework, which keep each anode exactly spaced apart from the adjacent cathodes.

Figure 3:
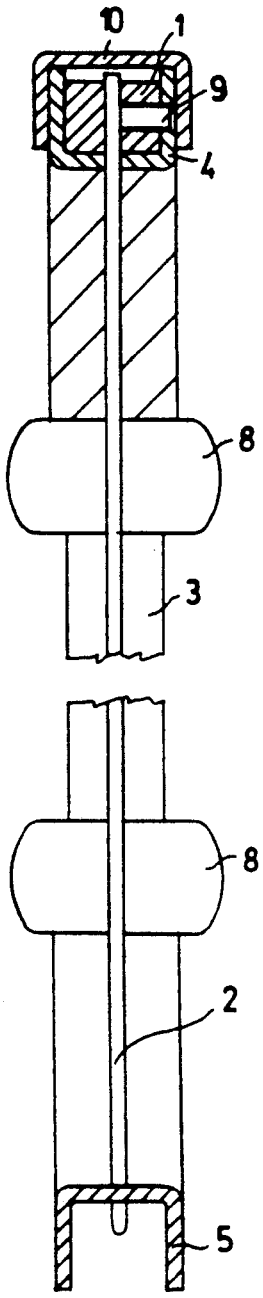
FIG. 3 shows a sectional view made along the section line III—III of FIG. 1.

In FIG. 3, the details are shown of the insertion of the bent ends of the fork-shaped element of bimetallic conductor inside the structural shape 5, and of the fastening, by means of a relevant compression screw, of the free ends of said fork-shaped elements inside the copper bus bar, through the holes 9. A structural shape made from a plastics material 10 is superimposed, as a cover, to the copper bar, in order to protect it against the electrolyte drops which otherways would strike said copper bar during the removal of the cathodes.

The advantages of the anodic structure according to the present invention can be summarized as follows:

High electrical conductivity:

Copper constitutes approximately 90% of the surface-area of the cross-section of the bimetallic wire; each anode is capable of allowing currents of many hundreds of amperes to circulate without losses;

Light-weight:

As compared to the corresponding anodes made from Pb, this structure has a weight which is approximately 1/10 of the weight thereof. As a consequence, the structure of the electrolysis cell is very simplified;

Riduced overall dimensions of the metal components of the anode:

The distance between opposite-sign electrodes can be reduced to a minimal value;

Inalterability of the anodic surfaces:

Tantalum which coats, with a continuous and compact coat, the metal parts of the anode, is the best solution offered by the present state of the art, for providing a corrosion-preventing coating;

Low oxygen overvoltage:

The catalytic layer of Pt and/or $PbO_2$, with which the tantalum anode is coated, secures the development of oxygen at the minimal possible voltage from the technical viewpoint;

The structure consisting of vertical, parallel wires, well spaced apart from each other, favors the rising of small bubbles of anodic gas, the free circulation of the electrolyte, and the continuous renewal of the solution at the cathode/solution interface. The cathodic current density can, hence, be increased up to the maximum levels, as allowed by the concentration of the ions of the metal to be deposited;

Owing to the same structure of the anode, the resulting anodic current density is 3–4 times as large as the cathodic current density.

This situation of high anodic density is favorable when solid products are formed at the anode.

In the case of Zn-containing electrolyte, manganese dioxide, which is formed on the anode of the cell, is preferentially formed in powder form. Therefore, the scales which adhere to lead anodes—which scales must be frequently removed from said anodes—are not formed.

This peculiarity can be applied to the production of electrolytic $MnO_2$ for dry batteries, in that $MnO_2$ is obtained in continuous mode by filtering the solution contained inside the cell, without which the electrolysis would have to be discontinued in order to remove the anodes coated with $MnO_2$. Therefore, the manual removal of the latter, and the expensive milling thereof, are both avoided.

We claim:

1. Insoluble anode for the electrolysis of aqueous solutions, comprising:

a bus bar of copper, the bus bar provided with vertical holes, an open framework supporting the bus bar, a plurality of electrical conductors, in the form of bimetallic wires having an inner copper core coated by an outer, thinner layer of a transition metal, each of the bimetallic wires formed into a fork-shaped element having at least two free ends, the fork-shaped elements fastened in a vertical position onto the framework, the free ends of the fork-shaped element inserted through the vertical holes provided in the bus bar, and a plurality of horizontal holes included in the bus bar for the attachment of the free ends of each of said fork-shaped elements, wherein the free ends are removably attached in the horizontal holes.

2. Anode according to claim 1, wherein the transition metal is selected from the group consisting of tantalum, titanium, and niobium.

3. Anode according to claim 1, wherein the bimetallic wire is coated by a catalytic layer selected from the group consisting of platinum, and lead dioxide.

4. Anode according to claim 1, wherein the fork-shaped elements are arranged in parallel, in a common plane.

5. Anode according to claim 1, wherein the framework includes a pair of uprights connected with a pair of upper and lower horizontal structural shapes.

6. Anode according to claim 5, wherein the pair of upper and lower horizontal structural shapes are provided with holes through which the bimetallic wires pass.

7. Anode according to claim 1, further comprising a plurality of spacers fastened in a predetermined position upon the framework, so as to keep the anode spaced apart from an adjacent cathode.

8. Anode according to claim 1, wherein the bus bar is provided with a sheltering cover.

9. Anode according to claim 1, wherein the element is substantially U-shaped.

10. Anode according to claim 1, wherein the framework includes an insulating plastics material.

11. Anode according to claim 1, further comprising a fastener fastening the free ends in the horizontal holes.

* * * * *